US005351861A

United States Patent [19]

Jovellana

[11] Patent Number: 5,351,861

[45] Date of Patent: Oct. 4, 1994

[54] BEVERAGE DISPENSER HAVING TURNTABLE-SUPPORTED MULTIPLE BEVERAGE CONTAINERS

[76] Inventor: Bartolome D. Jovellana, 16737 Mulvane St., Valinda, Calif. 91744

[21] Appl. No.: 52,796

[22] Filed: Apr. 23, 1993

[51] Int. Cl.[5] ..... B67D 5/60

[52] U.S. Cl. ..... 222/144

[58] Field of Search ..... 222/144, 144.5, 185, 222/168–169, 505, 509

[56] References Cited

U.S. PATENT DOCUMENTS

| | | | |
|---|---|---|---|
| 19,824 | 4/1858 | Bigelow | 222/144 |
| 128,956 | 7/1872 | Fellows | 222/144 X |
| 398,383 | 2/1889 | Crommer | 222/144 X |
| 410,514 | 9/1889 | Gee | 222/144 X |
| 614,000 | 11/1898 | Hutchison et al. | 222/144 |
| 656,072 | 8/1900 | Wild | 222/144 X |
| 686,296 | 11/1901 | Helmer | 222/144 |
| 912,281 | 2/1909 | Brunner et al. | 222/144 X |
| 1,424,682 | 8/1922 | Schlosser | 222/144 |
| 1,910,262 | 5/1933 | Schoenfeld | 222/144 X |
| 2,058,027 | 10/1936 | Martinet | 222/144 X |
| 2,199,196 | 4/1940 | Evans | 222/144 X |
| 3,682,356 | 8/1972 | Karle | 222/144 X |
| 4,664,297 | 5/1987 | Giovinazzi | 222/185 |
| 4,722,463 | 2/1988 | Anderson | 222/185 |
| 4,938,386 | 7/1990 | Roethel et al. | 222/505 X |

*Primary Examiner*—Kevin P. Shaver
*Attorney, Agent, or Firm*—Boniard I. Brown

[57] ABSTRACT

A rotary beverage dispensing device includes a turntable having an upstanding partition structure forming chambers facing away from the turntable rotational axis and beverage container support mechanism in each chamber. Each beverage container has a downwardly directed discharge spout, and a shut-off valve to control flow of liquid beverage through the spout. The dispensing device is especially designed for carbonated beverages and fruit juices, and enables the user to select different beverages for dispensing, depending on individual preference.

14 Claims, 2 Drawing Sheets

BEVERAGE DISPENSER HAVING TURNTABLE-SUPPORTED MULTIPLE BEVERAGE CONTAINERS

BACKGROUND OF THE INVENTION

1. Field of the Invention

The present invention relates to a beverage dispenser for consumable liquids such as carbonated soft drinks or fruit juices.

2. Prior Developments

U.S. Pat. No. 4,664,297 to Giovinazzi discloses a beverage dispenser comprising a cradle for supporting a plastic bottle containing a carbonated soft drink. A manually-operated valve is attached to the neck of the bottle to control the flow of the beverage out of the bottle. The dispenser is particularly designed for disposition in a refrigerator.

U.S. Pat. No. 4,722,463 to Anderson discloses a beverage dispenser having a specially constructed spool valve for controlling the flow of a liquid beverage out of a beverage-containment bottle.

In both of these patented arrangements, a single beverage-containment bottle is supported on a cradle in a tilted condition wherein the cradle-bottle unit can fit into a conventional refrigerator, with the liquid dispenser valve disposed a slight distance above the front edge of a refrigerator shelf. A person opens the refrigerator door and holds a drinking glass or cup below the dispenser valve in order to fill a cup or glass with the beverage. In both patented arrangements, there is provision for only one beverage-container on the cradle or support device. The present invention contemplates a different arrangement wherein a plurality of beverage containers is provided on the support structure, thereby giving the user a choice of different beverages.

SUMMARY OF THE INVENTION

The present invention contemplates a beverage dispenser including a turntable and a vertical partition structure extending upwardly therefrom to define multiple chambers or compartments for individual liquid containers. In one form of the invention, the partition structure comprises four vertical walls radiating from the turntable axis to define four separate chambers facing away from the axis, each chamber being adapted to receive one beverage container.

By rotating the turntable, a person gains access to different ones of the beverage containers, thus enabling a choice of beverage to be consumed.

The invention is applicable to different types of beverages, e.g., carbonated soft drinks, fruit juices, etc. For soft drink beverages, the turntable support structure is designed to mount a plurality of conventional soft drink bottles in inverted positions in the various chambers. Each bottle has a discharge spout having a valve and downwardly-extending valve operator so arranged that the person can fill a cup or glass by moving a cup or glass against the valve operator, thus to open the valve to permit beverage to flow downwardly through the spout into the cup or glass. It is not necessary physically to turn a handle or push a button. The act of moving the glass or cup against the valve operator automatically opens the valve to discharge liquid.

For juice type beverages, the beverage dispenser comprises a plurality of specially constructed open-topped containers having segmental configurations, which are grouped together compactly to collectively occupy a cylindrical zone above the turntable. Each container may be filled with a different juice, etc.

The segment-shaped containers are disposed above the turntable surface so that a glass or cup may be placed on the turntable surface below a selected container. Downflow of liquid from each respective container into a glass or cup is controlled by a manual valve incorporated in a discharge spout at or near the lower end of the container.

The segment-shaped containers are removable from the turntable for filling with juices or other liquids. Removability also facilitates the process of washing the containers prior to each container-filling operation.

A principal aim of the present invention is the provision of a beverage dispenser which includes a plurality of beverage containers on a rotary turntable structure, with the containers elevated above the turntable surface so that a glass or cup may be placed on the turntable to receive a liquid beverage from a selected container.

DESCRIPTION OF A PREFERRED EMBODIMENT OF THE INVENTION

Figure 1:
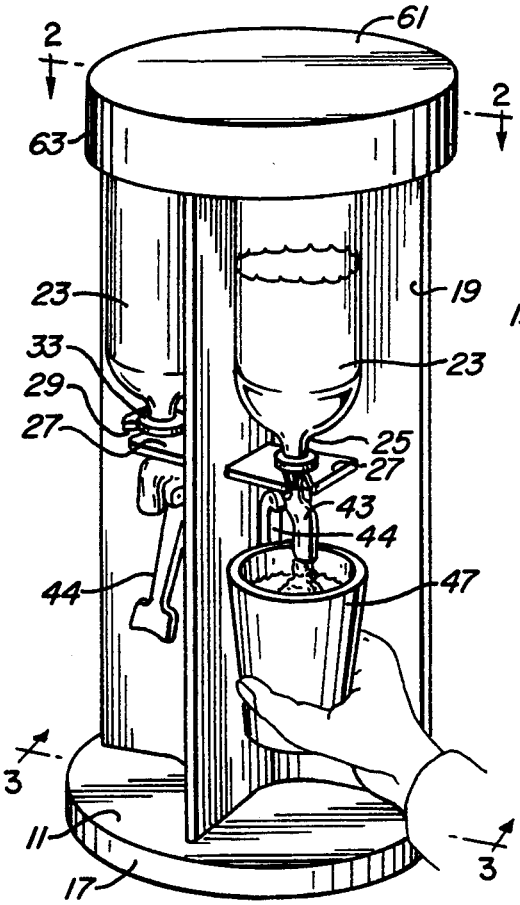
FIG. 1 is a perspective view of a beverage dispenser according to the invention.

Referring to FIGS. 1 through 6, a beverage dispenser comprises a flat turntable 11 rotatably mounted on a base 13, whereby the turntable is turnable about a central vertical axis 15. Preferably, the base and turntable have mating guide grooves or tracks to receive a plurality of ball bearings, whereby the turntable is rotatable with a minimal manual effort. The turntable comprises a flat circular plate having a downturned peripheral flange 17 extending almost to the lower surface of base 13, whereby the base 13 is concealed when the beverage dispenser is disposed on a kitchen countertop or other support surface.

Figure 2:
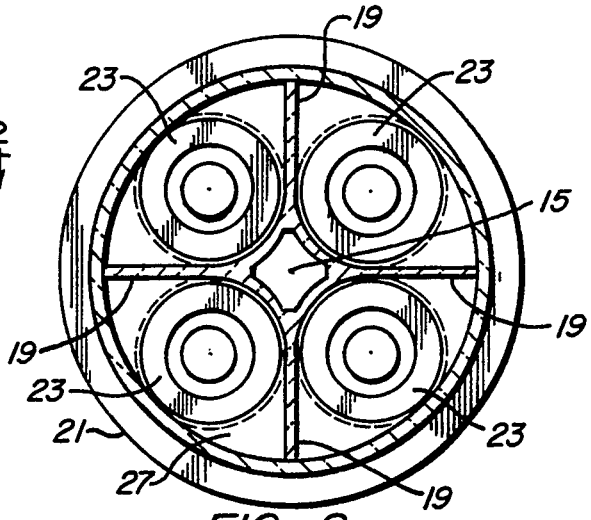
FIG. 2 is a sectional view taken on line 2—2 in FIG. 1.
Figure 3:
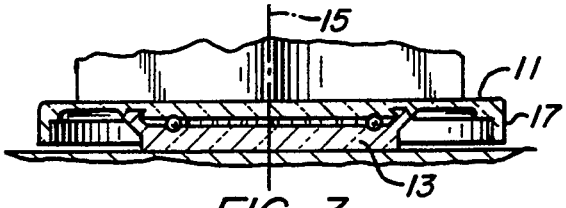
FIG. 3 is a fragmentary sectional view taken on line 3—3 in FIG. 1.

Extending upwardly from the turntable is a vertical partition structure defining four separate chambers facing away from the turntable central axis 15. As best shown in FIG. 2, the partition structure comprises four vertical walls 19 extending outwardly from the central axis 15 toward the turntable peripheral edge 21, thus to form four segmental chambers facing away from axis 15. A beverage container 23 is supported in each chamber.

As shown in FIGS. 1 through 6, each beverage container comprises a conventional plastic soft drink bottle. Each bottle is supported in an inverted position with its bottom wall facing upwardly, and with its narrow neck 25 extending downwardly so that liquid is discharged in a downward direction.

Figure 4:
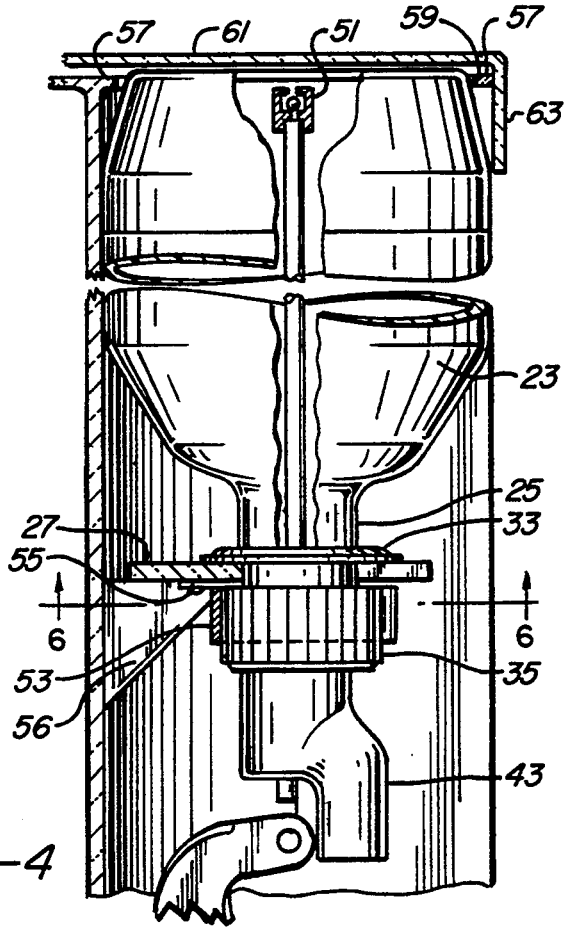
FIG. 4 is an enlarged fragmentary view of structural details of the FIG. 1 dispenser.
Figure 6:
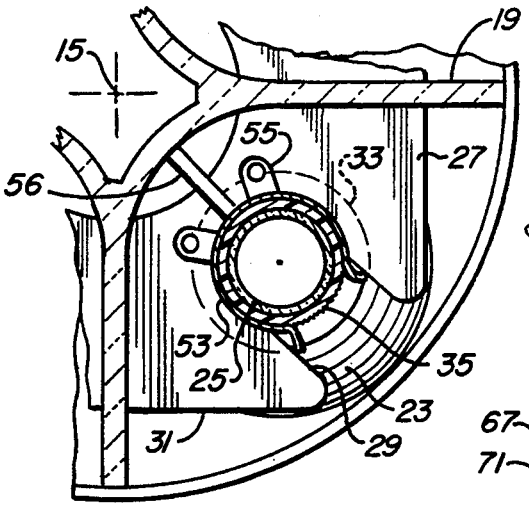
FIG. 6 is a fragmentary sectional view taken on line 6—6 in FIG. 4.

FIG. 4 shows a shelf structure for supporting the inverted bottle. A flat shelf 27 extends horizontally from two adjacent vertical partition walls 19 to form a bottle support surface. As shown in FIG. 6, the shelf defines a recess or notch 29 in its front edge 31, whereby the bottle neck structure 25 may be inserted horizontally into the recess to assume the position shown in FIG. 6. The rear surface of recess 29 is curved to conform to the cylindrical configuration of the bottle neck.

Conventional soft drink bottles of the conventional size have an annular ring-like flange extending about the bottle neck, presumably for reinforcement purposes. The shelf structure of this invention is adapted to extend under the annular ring-like bottle flange, whereby the weight of the bottle is transmitted through the flange to the shelf. As shown in FIG. 4, a flange 33 on the neck of the bottle seats against the upper surface of the shelf, whereby the shelf serves to support the bottle.

A spring clip structure 53 is mounted on the underside of each shelf 27 for releasable gripping engagement with a spout-valve assembly threaded onto the neck of container 23. The spring clip structure is adapted to prevent inadvertent dislodgement of the bottle from shelf 27, while permitting removal of the bottle, as when the bottle is empty.

Figure 5:
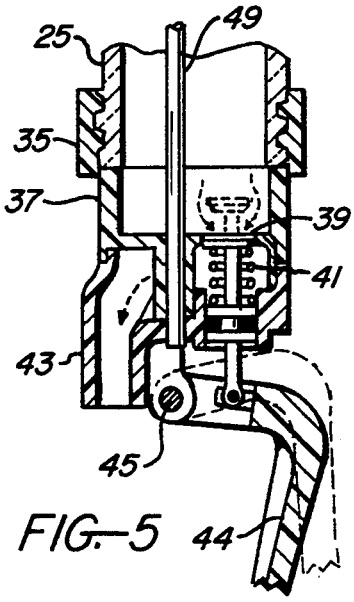
FIG. 5 is a fragmentary sectional view through a valve and valve operator of the FIG. 1 dispenser.

FIG. 5 shows the spout-valve assembly construction, which comprises a tubular connector 35 internally threaded for connection with the bottle neck 25. The connector extends downwardly to form a valve housing body 37 to accommodate a poppet valve element 39 which is biased downwardly against an associated valve seat by a coil spring 41. A spout 43 is formed by an auxiliary housing having an upper annular end snap fitted on the lower end of the poppet valve housing 37 to define the valve-spout assembly. The spout structure may be disconnected from the valve housing as for cleaning the housing interior surfaces.

The valve is opened and closed by means of a paddle-type operator 44 that is swingably attached to the spout structure by a pivot pin 45. As shown in FIG. 1, carbonated beverage may be dispensed from bottle 23 into a drinking vessel 47 by pushing the vessel against operator 44 with sufficient force to deflect the operator about pivot pin 45 (FIG. 5). The stem of the poppet valve 39 has a pin-slot connection with operator 44, whereby rearward deflection of the operator causes the poppet valve element to move upwardly, thereby permitting the liquid to flow downwardly through the valve seat and discharge spout 43 into the drinking vessel. When the vessel is moved away from the paddle type operator 44, coil spring 41, in cooperation with the liquid head, returns the valve element to its closed position.

In order to prevent a partial vacuum condition in bottle 23, there is provided an elongated vent tube 49. The lower end portion of the tube extends through a tubular mount integral with valve housing 37; the upper end of tube 49 carries a miniature check valve 51 (FIG. 4) so that air can flow upwardly through the tube into the bottle to prevent a partial vacuum from forming as the bottle is progressively emptied. The check valve prevents downflow of gas through the tube as might result in loss of carbonization.

When container 23 is emptied, the valve-spout assembly of FIG. 5 may be removed from the emptied beverage container and screwed onto a new, full container for continued use of the beverage system. The valve-spout assembly (including vent tube 49) is a reusable component repeatedly usable with different beverage containers 23.

Referring again to the spring clip construction for retaining bottle 23 on shelf 27, FIGS. 4 and 6 show the spring clip as a resilient band 53 having two ears 55 for attaching the band to the underside of shelf 27. The band has a generally U-configuration, as viewed in FIG. 6, with the band interior surface being curved to conform generally with the contour of tubular connector 35. The spring clip comprises two opposed spring arms having end portions normally spaced closer than the external diameter of tubular connector 35. The ends of the spring arms are flared apart so that after connector 35 is attached to a beverage bottle (FIG. 5), the inverted bottle may be manipulated to force connector 35 through the space between the flared ends of the clip spring arms, thus to temporarily spread the spring arms further apart, whereby the connecter may be snapped into the circumscribed space (FIG. 6). The spring arms grip tubular connector 35 to prevent inadvertent dislodgement of the bottle from its position supported on shelf 27. The external surface of the tubular connector may be serrated, as shown in FIG. 6, to provide a tighter frictional grip of the spring arms on the connector surface. A gusset 56 may be provided to reinforce shelf 27 and the resilient band 53 (FIG. 4).

The inverted beverage container 23 is prevented from toppling over by a radial wall structure 57 (FIG. 4) at the upper end edges of vertical partition walls 19. Four large circular holes 59 are defined in radial wall 57 to fit about side surfaces of individual bottles 23. Each bottle may be installed by inverting the bottle and then pushing it upwardly into one of the holes 59, after which the neck structure of the bottle is inserted into the associated recess 29 in shelf 27.

An optional ornamental cover 61 may be removably disposed on the partition structure to conceal the ends of the inverted bottles. The cover comprises a circular disk having a downwardly extending rim flange 63. Flange 63 has such integral diameter that it fits against the outer edges of walls 19 (FIG. 2). The cover is thus firmly retained on the partition structure. It is removable—e.g., to gain access to the inverted bottles. The main purpose of the cover is to provide an ornamental shroud about the upper ends of bottles 23.

As shown in FIG. 2, the turntable 11 diameter is greater than the diameter of cover 61, and thus the peripheral of the turntable is spaced outwardly from the discharge spouts of the inverted bottles 23. The user has to insert the drinking vessel 47 (FIG. 1) a measurable distance into the chambers formed by vertical walls 19 in order to dispense a beverage into the vessel. Any spillage of the liquid collects on the turntable, rather than on a counter surface or tablecloth that may extend beyond the turntable. With spillage confined to the turntable, adjacent surfaces are not inadvertently stained or otherwise discolored by the liquid.

Figure 7:
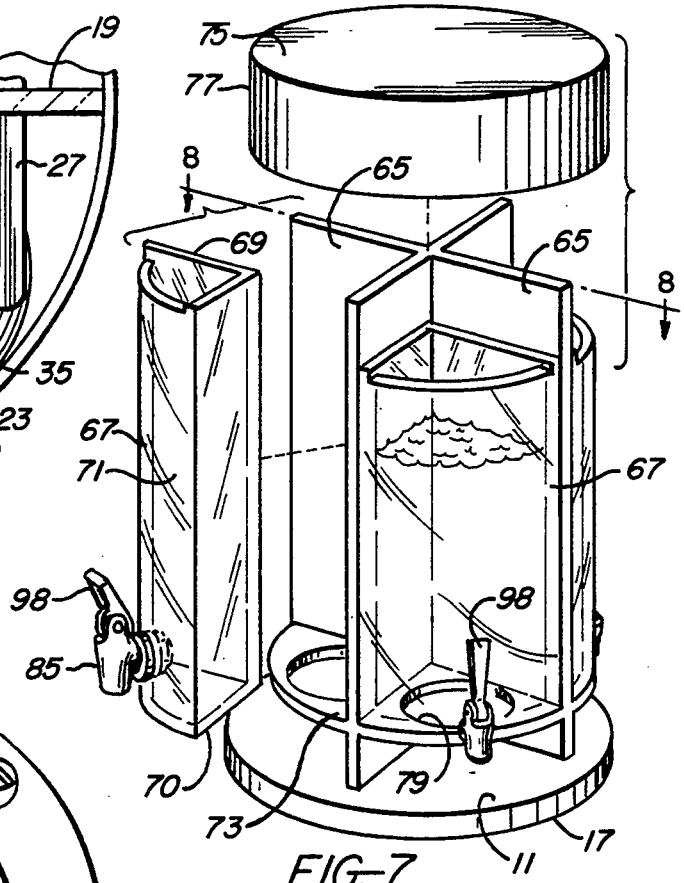
FIG. 7 is an exploded perspective view of another dispenser embodying features of the invention.
Figure 8:
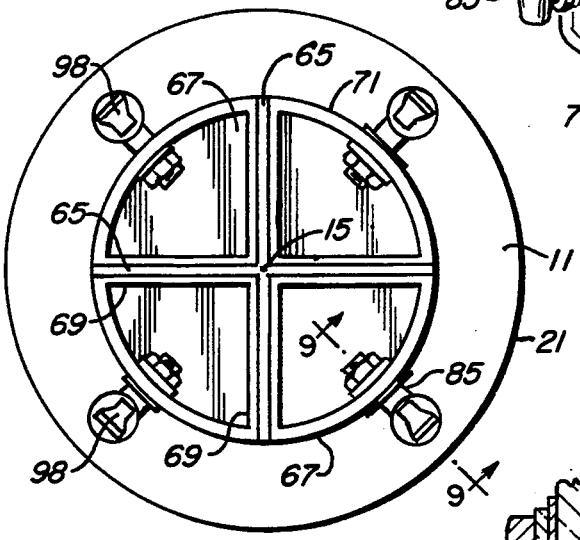
FIG. 8 is a top plan view of the FIG. 7 dispenser, with its cover removed.
Figure 9:
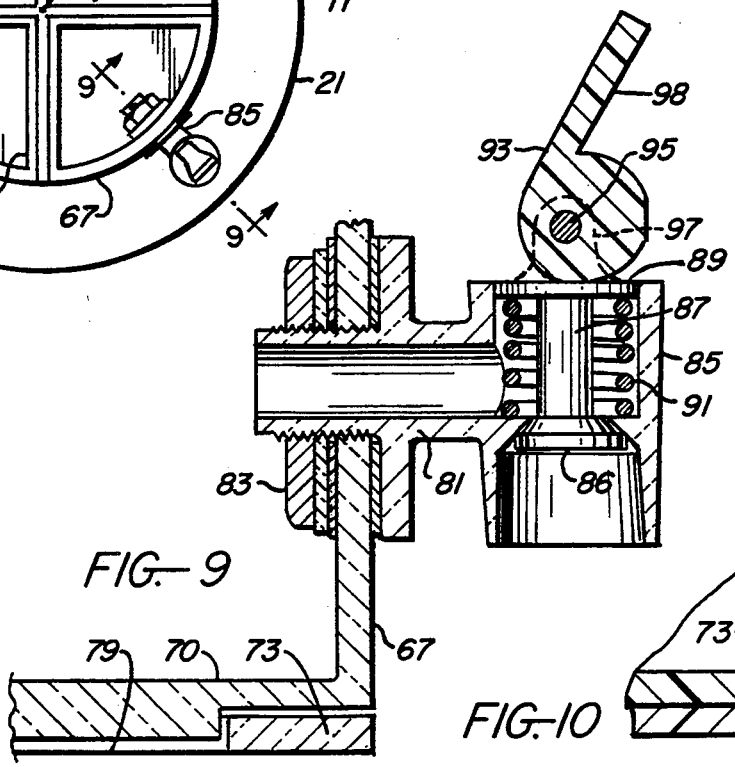
FIG. 9 is an enlarged fragmentary sectional view taken on line 9—9 in FIG. 8.

FIGS. 7 through 9 illustrate another embodiment of the invention for storing and dispensing non-carbonated beverages, such as fruit juices. The turntable 11 (FIG. 8) partition structure comprises four vertical walls 65 radiating from the turntable rotational axis 15 to form four segmental chambers for receiving removable beverage containers 67.

Each beverage container comprises two flat side walls 69, a third arcuate side wall 71, and a bottom wall 70. As seen in FIG. 7, the upper edges of the container side walls provide a top access opening for the container, whereby the container may be filled with liquid, and periodically washed. Each beverage container may preferably be formed of a transparent plastic material, e.g., Plexiglas.

Each beverage container is supported on a horizontal shelf 73 which extends from adjacent ones of partition walls 65 in spaced relation to the subjacent turntable 11. The beverage containers are installed with side walls 69 against vertical partition walls 65, with the arcuate container walls 71 being generally coextensive with the arcuate front edges of shelves 73. As shown in FIG. 8, the arcuate container walls 71 collectively define a cylindrical surface centered on central axis 15.

A circular cover 75, having a rim flange 77, may be positioned over the partition structure to encircle the upper ends of containers 67. The inner cylindrical surface of rim flange 77 is sized to fit about arcuate container walls 71 with little looseness or play, so that the cover acts as a retainer to prevent accidental or inadvertent dislodgement of the beverage containers from the shelves 73.

As shown in FIG. 7, the upper edge of the arcuate side wall 71 of each container is spaced a slight distance below the upper edge of the associated flat side wall 69. This is advantageous in minimizing the potential for the cover 75 to frictionally stick against the convex arcuate surfaces of side walls 71. The rim flange 77 may terminate on a plane coincident with the upper edges of walls 71 so that the cover has no opportunity for sticking. The cover rim flange overlaps edge areas of the container side walls 71 effectively to retain the containers on the partition structure. The upper edge of arcuate wall 71 may also be advantageous in confining liquid spillage to the upper edge of the arcuate wall, thereby lessening any spillage over the upper edges of walls 69.

Each shelf 73 may have a large circular hole 79 for material and weight reduction purposes. Each hole 79 may also be used as a further means for retaining container 67 on the shelf. As shown in FIG. 9, the bottom wall of the container has a thickened disc-like area engaged or mated with the circular hole 79 in the shelf, thus to prevent the container from shifting laterally off of the shelf. The container must be lifted upwardly to remove it from the associated shelf 73.

Figure 10:
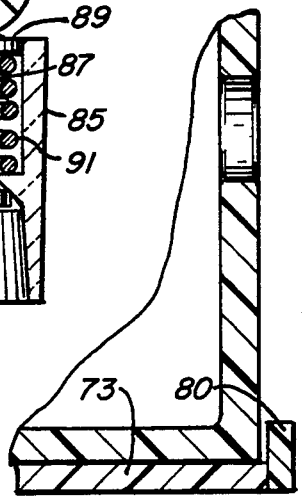
FIG. 10 is a fragmentary sectional view taken in the direction of FIG. 9, showing alternate structural details which may be utilized according to the invention.

FIG. 10 shows alternate means for retaining a container on an associated shelf, comprising a narrow arcuate strip 80 glued or otherwise attached to the front arcuate edge of shelf 73, thus to form an upstanding lip. The container must be lifted from the shelf before it can be removed.

The container-retention devices of FIGS. 9 and 10 are considered optional features of the invention. The invention can be practiced without such features because cover 75 serves for container retention.

Each beverage container 67 is equipped with a downwardly directed liquid discharge spout and a valve for controlling liquid flow through the spout. As shown in FIG. 9, the spout structure comprises a housing 85 having a flanged tube element 81 extended through a small opening in the arcuate side wall of the container near its bottom wall. A nut 83 is threaded onto tube element 81 to attach the spout structure to the container. Nut 83 may be unthreaded from tube element 81 if it becomes necessary to clean the spout structure separately from container 67.

The valve comprises a poppet valve element 86 having a stem 87 connected to a circular disk 89. A coil spring 91 extends between the disk and the valve seat wall to normally draw valve element 86 upwardly to its closed position (FIG. 9). A cam operator 93 has pivot pins 95 extended into circular openings in ears 97 formed integrally with housing 85. A handle 98 on the cam operator may be moved clockwise to depress disk 89 to open the valve.

As shown in FIG. 8, the diameter of turntable 11 is greater than the diameter of the container assembly, thus to form a platform for supporting a drinking cup or glass while liquid is being dispensed into a cup or glass. Any liquid spilled during this process will collect on the turntable surface, rather than on the adjacent table or counter surface.

The valve of FIG. 9 is illustrative of different valves that may be used with the invention. The invention is concerned more particularly with turntable construction and the partition structure which forms the segment-shaped chambers for housing and supporting liquid beverage containers. The beverage containers may be used for carbonated beverages, as shown in FIGS. 1 through 6, or the beverage containers may be used for fruit juices (FIGS. 7 through 9). Employment of a turntable, in conjunction with the upstanding partition structure, enables a homeowner or restaurant manager to have a choice as to the type of beverage to be consumed on any particular occasion.

The drawings show two different constructions for dispensing carbonated beverages or fruit juices. However, it is contemplated that both beverage types could be dispensed from a single rotary unit. For example, the rotary structure can be designed or adapted so that two of the four chambers are adapted for carbonated beverage containers while the other two chambers are adapted for fruit juice containers.

In a preferred arrangement, the rotary dispensing unit is partitioned to define four segment-shaped chambers. The unit can also be designed to provide a different number of chambers, such as three.

Thus there has been shown and described a novel beverage dispenser having turntable-supported multiple beverage containers which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A beverage dispenser comprising:

a base having a central vertical axis, a circular turntable rotatably mounted on said base for rotation about said central axis, said turntable having a peripheral edge, partition means extending upwardly from said turntable, said partition means comprising a plurality of vertical partition walls extending radially from said central axis toward the turntable peripheral edge to define a plurality of segmental chambers, each vertical partition wall having an outer vertical edge, beverage container support means in each chamber, a removable beverage container supportable on each support means, each beverage container having a downwardly directed liquid discharge spout, and a valve controlling liquid flow through the spout, said partition means being affixed to the turntable, whereby the turntable and partition means are rotatable as a unit for access to any selected beverage container, each said container support means comprising a shelf disposed above the turntable to support the container elevated a substantial distance above the turntable, whereby a drinking vessel may be placed on said turntable below the spout to dispense a beverage into the vessel, the outer vertical edges of said vertical partition walls defining an imaginary circular boundary for said segmental chambers, said circular turntable having a larger diameter than said circular boundary whereby liquid spillage occurring during a dispensing operation collects on the turntable surface rather than outside the turntable, each beverage container being a soft drink bottle having a relatively narrow neck defining a discharge opening for the bottle contents, each bottle being removably disposed in an inverted position in one of said segmental chambers, with the bottle neck extending vertically downwardly through the associated shelf, each liquid discharge spout and associated valve comprising an assembly separate from the associated bottle, each separate assembly comprising an internally threaded tubular connector adapted for threaded connection with the neck of the associated bottle, each said valve comprising an operator extending downwardly below the associated spout, whereby beverage dispensing is achieved by moving a drinking vessel against the valve operator.

2. A beverage dispenser according to claim 1, wherein:

said turntable comprises a flat plate and a peripheral flange extending downwardly into proximity with said base, whereby the base is concealed when the beverage dispenser is disposed on a support surface.

3. A beverage dispenser comprising:

a base having a central vertical axis, a turntable rotatably mounted on said base for rotation about said central axis, said turntable having a peripheral edge, partition means extending upwardly from said turntable, said partition means comprising a plurality of vertical partition walls extending radially from said central axis toward the turntable peripheral edge to define a plurality of segmental chambers, each vertical partition wall having an outer vertical edge, beverage container support means in each chamber, a removable beverage container supportable on each support means, each beverage container having a downwardly directed liquid discharge spout, and a valve controlling liquid flow through the spout, said partition means being affixed to the turntable, whereby the turntable and partition means are rotatable as a unit for access to any selected beverage container, each said container support means comprising a shelf disposed above the turntable to support the container elevated a substantial distance above the turntable, whereby a drinking vessel may be placed on said turntable below the spout to dispense a beverage into the vessel, a removable cover disposed on said partition means to overlie the beverage containers, said cover having a rim flange fitting about the outer edges of said vertical partition walls, said rim flange extending downwardly to overlap the beverage containers, whereby said flange forms a shroud partially concealing said containers, each beverage container having two flat inclined side walls and a third arcuate side wall, said containers so installable on said shelves that the inclined side walls are disposed adjacent the vertical partition walls, and the arcuate side walls of the containers define an imaginary cylinder centered on said central vertical axis, the downwardly extending rim flange of said cover having an inner cylindrical surface sized to fit about the arcuate side walls of the containers to prevent dislodging of the containers from the segmental chambers, and each beverage container having a top access opening defined by upper edges of the container side walls, the upper edge of each arcuate side wall being slightly below the upper edges of the associated inclined side walls whereby any liquid spillage at the top access openings occurs at the arcuate side wall and not at the acutely angled side walls.

4. A beverage dispenser according to claim 3, wherein:

each shelf has a hole therein, each container has a bottom wall seatable on an associated shelf, each container bottom wall has a zone adapted to engage in said hole in the shelf, whereby the container must be lifted upwardly to remove the container from the associated shelf.

5. A beverage dispenser according to claim 3, wherein each container is formed of a transparent plastic material.

6. A beverage dispenser according to claim 3, wherein:

said turntable comprises a flat circular plate and a peripheral flange extending downwardly almost to the lower surface of the base, whereby the base is concealed when the beverage dispenser is placed on a support surface.

7. A beverage dispenser according to claim 6, wherein:

said removable cover is circular, and said circular turntable has a larger diameter than said cover, whereby liquid spillage occurring during a dispensing operation is collected on the turntable surface, rather than outside the turntable.

8. A beverage dispenser according to claim 3, wherein:

each beverage container is a soft drink bottle having a relatively narrow neck which defines a discharge opening for the bottle contents, and each bottle is removably disposed in an inverted position in one of said chambers, with the bottle neck extending vertically downwardly through the associated shelf.

9. A beverage dispenser according to claim 8, wherein:

each liquid discharge spout and associated valve comprise an assembly separate from the bottle, and each said separate assembly comprises an internally threaded tubular connector adapted for threaded connection with the neck of the associated bottle.

10. A beverage dispenser according to claim 9, wherein:

each shelf has a front edge facing away from said central axis, and wherein said shelf front edge defines a recess configurated and sized to partially encircle the neck of the associated inverted bottle.

11. A beverage dispenser comprising:

a base having a central vertical axis, a turntable rotatably mounted on said base for rotation about said central axis, said turntable having a peripheral edge, partition means extending upwardly from said turntable, said partition means comprising a plurality of vertical partition walls extending radially from said central axis toward the turntable peripheral edge to define a plurality of segmental chambers, each vertical partition wall having an outer vertical edge, beverage container support means in each chamber, a removable beverage container supportable on each support means, each beverage container having a downwardly directed liquid discharge spout, and a valve controlling liquid flow through the spout, said partition means being affixed to the turntable, whereby the turntable and partition means are rotatable as a unit for access to any selected beverage container, each said container support means comprising a shelf disposed above the turntable to support the container elevated a substantial distance above the turntable, whereby a drinking vessel may be placed on said turntable below the spout to dispense a beverage into the vessel, a removable cover on said partition means to overlie the beverage container, said cover having a rim flange fitting about the outer edges of said vertical partition walls, said rim flange extending downwardly to overlap the beverage containers, whereby said flange forms a shroud partially concealing said containers, each beverage container being a soft drink bottle having a relatively narrow neck defining a discharge opening for the bottle contents, each bottle being removably disposed in an inverted position in one of said segmental chambers with the bottle neck extending downwardly through the associated shelf, each liquid discharge spout and associated valve comprising an assembly separate from the associated bottle, each said assembly comprising an internally threaded tubular connector for threaded connection with the neck of the associated bottle, each said shelf having a front edge facing away from said central axis, the front edge of each shelf having a recess configured and sized to partially encircle the neck of the associated inverted bottle, and a spring clip mounted on each shelf for gripping engagement with the tubular connector of an associated soft drink bottle, and wherein each spring clip comprises two opposed spring arms vertically aligned with the recess in the associated shelf, said spring arms having terminal ends normally spaced apart a lesser distance than the external diameter of the associated tubular connector, whereby when an inverted soft drink bottle is inserted into the chamber the spring arms spread further apart to permit the tubular connector to pass into the space circumscribed by the spring arms.

12. A beverage dispenser according to claim 11, wherein:

each said valve comprises an operator extending downwardly below the associated spout, whereby a beverage dispensing operation may be achieved by moving a drinking vessel against the valve operator.

13. A beverage dispenser according to claim 11, wherein:

each said spring clip is mounted on the undersurface of the associated shelf, whereby the weight of the bottle is carried by the shelf rather than the spring clip.

14. A beverage dispenser according to claim 13, wherein each tubular connector has a serrated external side surface to facilitate a strong gripping engagement between the spring clip and the tubular connector.

* * * * *